US005407326A

United States Patent [19]

Lardellier

[11] Patent Number: 5,407,326

[45] Date of Patent: Apr. 18, 1995

[54] HOLLOW BLADE FOR A TURBOMACHINE

[75] Inventor: Alain M. J. Lardellier, Melun, France

[73] Assignee: Societe Nationale d'Etude et de Construction de Moteurs d'Aviation "S.N.E.C.M.A.", Paris, France

[21] Appl. No.: 227,373

[22] Filed: Apr. 14, 1994

Related U.S. Application Data

[62] Division of Ser. No. 111,892, Aug. 26, 1993, Pat. No. 5,343,619.

[30] Foreign Application Priority Data

Sep. 2, 1992 [FR] France ..... 92 10470

[51] Int. Cl.[6] ..... F01D 5/18

[52] U.S. Cl. ..... 416/233; 416/232

[58] Field of Search ..... 416/232, 233, 219 R, 416/239, 248

[56] References Cited

U.S. PATENT DOCUMENTS

| | | | |
|---|---|---|---|
| 1,380,431 | 6/1921 | Smith | 416/233 |
| 1,718,061 | 6/1929 | Miller | 416/232 |
| 1,778,340 | 10/1930 | Reed | 416/233 |
| 1,855,589 | 4/1932 | Reed | 416/144 |
| 2,221,722 | 11/1940 | Reynolds | 416/232 |
| 2,862,686 | 12/1958 | Bartlett | 416/219 |
| 2,882,974 | 4/1959 | Boegehold | 416/233 |
| 3,628,226 | 12/1971 | Nelson . | |
| 3,761,201 | 9/1973 | Silverstein et al. | 416/232 |
| 4,882,823 | 11/1989 | Weisert et al. . | |

FOREIGN PATENT DOCUMENTS

| | | | |
|---|---|---|---|
| 1577388 | 8/1969 | France . | |
| 2074958 | 10/1971 | France . | |
| 1935377 | 3/1970 | Germany | 416/233 |
| 563525 | 6/1975 | Switzerland | 416/233 |
| 384523 | 12/1932 | United Kingdom | 416/233 |

OTHER PUBLICATIONS

Abstract of Japanese Patent 56 88902, Jul. 18, 1981.

*Primary Examiner*—Edward K. Look
*Assistant Examiner*—James A. Larson
*Attorney, Agent, or Firm*—Oblon, Spivak, McClelland, Maier & Neustadt

[57] ABSTRACT

A hollow blade for a turbomachine includes a unitary body having a multiplicity of transverse cavities in at least the aerofoil shaped portion of the blade, and plugs disposed within the cavities for restoring the surface continuity of the intrados and extrados faces of the aerofoil shaped portion, the plugs being rigidly secured to the unitary body, such as by welding.

22 Claims, 2 Drawing Sheets

HOLLOW BLADE FOR A TURBOMACHINE

This is a division of application Ser. No. 08/111,892, filed on Aug. 26, 1993, U.S. Pat. No. 5,34,619.

BACKGROUND OF INVENTION

1. Field of the Invention

The present invention relates to a hollow blade for a turbomachine, especially a large chord fan blade.

The advantages of using large chord blades in turbomachines are known, particularly in the case of the fan rotor blades in a bypass turbojet engine. These blades must cope with severe operating conditions, and, in particular, must possess mechanical properties giving adequate anti-vibration characteristics and resistance to impact by foreign bodies. The aim of achieving adequate speeds at the tips of the blades has also led to research into reducing the masses of the blades. This has resulted in the use of hollow blades.

2. Description of the Prior Art

French Patent No. 1 577 388 discloses one example of a hollow blade in which the blade is made up of two wall elements between which a honeycomb structure is arranged, the wall elements being made of a titanium alloy and being formed to the desired profile and shape by hot pressing.

U.S. Pat. No. 3 628 226 describes a method of manufacturing a hollow compressor blade involving a metal bonding by diffusion welding of two elements or half-blades having a flat grooved assembly surface.

Other known techniques for obtaining hollow blades, particularly for the fans of turbojet engines, combine operations or pressurized metal diffusion welding and pressurized gas superplastic forming. One example of this technique is disclosed in U.S. Pat. No. 4 882 823.

SUMMARY OF THE INVENTION

One of the aims of the invention is to avoid making use of these known techniques, which are complex to implement and particularly delicate to tune.

Accordingly, the invention provides a hollow blade for a turbomachine, said blade including an aerofoil shaped portion having an intrados face and an extrados face, said blade comprising a unitary body, means in said body defining a multiplicity of transverse cavities in said aerofoil shaped portion according to the thickness thereof, and plugs disposed within said cavities to restore the surface continuity of said intrados and extrados faces of said aerofoil shaped portion of said blade, said plugs being rigidly secured to said unitary body.

The invention also provides a method of manufacturing the hollow blade comprising the following steps:

a) producing a unitary blade blank by forging, said blade blank including an aerofoil shaped portion;

b) machining a multiplicity of holes in said aerofoil shaped portion such that a zone of specific width is left clear at the edge of said aerofoil shaped portion and said holes are substantially evenly distributed over the remaining area of said aerofoil portion and provide a cavity ratio of about 90% in said remaining area;

c) producing plugs with a shape adapted to the holes formed during step (b) and to the profile of the respective surface of said aerofoil shaped portion, be it the intrados face or the extrados face;

d) placing said plugs in position in said holes formed during step (b);

e) fixing said plugs to said blade blank by high energy beam welding while said plugs are in position in said holes; and f) finishing said blank to obtain the required aerodynamic profile.

Depending on the mechanical characteristics required, the cavities may have a circular cross-section, or may have other shapes, such as hexagonal. The cavities may be through holes or blind holes, and in the latter case they may be situated in the intrados face or the extrados face of the aerofoil shaped portion of the blade.

When the cavities are through holes, a first plug may be placed in each hole on the intrados face side of the blade, and a second plug placed in each hole on the extrados face side. Alternatively, the second plugs may be welded together in pairs as a preliminary assembly step before-being placed and fixed in the holes.

Other features and advantages of the invention will become apparent from the following description of the preferred embodiments of the invention, which are given by way of example only, with reference to the attached drawings.

DESCRIPTION OF THE PREFERRED EMBODIMENTS

Figure 1:
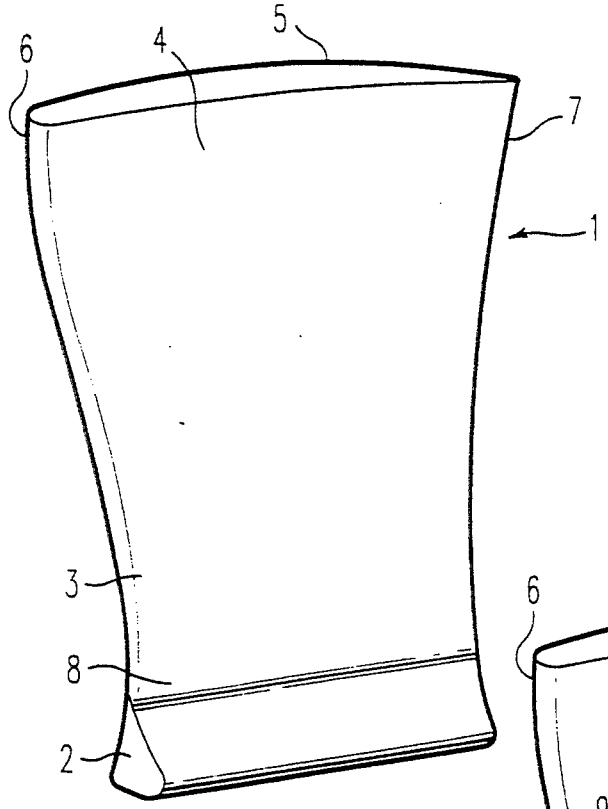
FIG. 1 is a diagrammatic view of a unitary forged blade blank, at the initial stage of manufacturing a hollow turbomachine blade in accordance with the invention.
Figure 2:
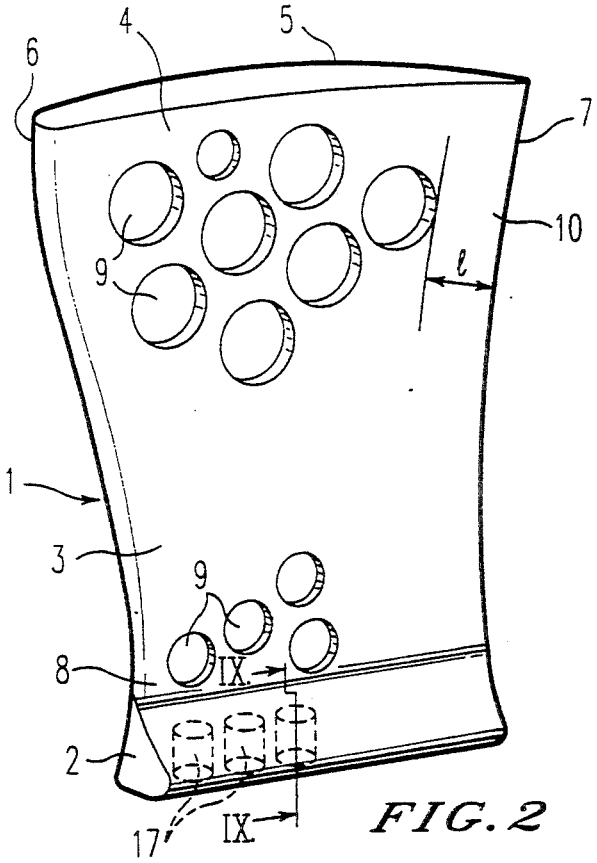
FIG. 2 is a diagrammatic view of the blade blank of FIG. 1, at an intermediate stage in the manufacture of the blade.
Figure 3:
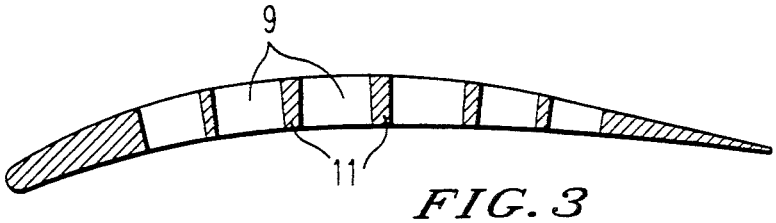
FIG. 3 is a cross-section through the blade blank shown in FIG. 2.
Figure 4:
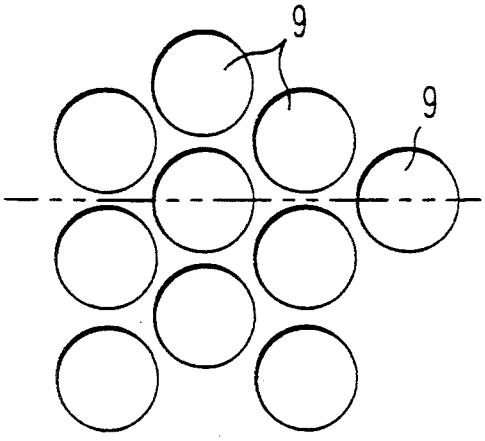
FIG. 4 is a diagram showing the distribution of the cavities over the aerofoil portion of one embodiment of a blade in accordance with the invention.

Embodiments of a hollow turbomachine blade in accordance with the invention may be obtained by carrying out the following manufacturing stages.

a) In the first stage of the manufacture a unitary blade 1, such as diagrammatically shown in FIG. 1, is roughly formed to a size close to its final dimensions by forging, applying a process known per se. This blade 1 has a fixing base or root 2, and a streamlined aerofoil shaped portion 3 intended to be located in the air flow path of the turbomachine, this portion 3 having two outer walls, defining the intrados face 4 and the extrados face 5 of the blade, connected by a leading edge 6 and a trailing edge 7. Depending on the particular application, the blade may include an intermediate part, termed a transition portion or shank 8, between the root 2 and the aerofoil shaped portion 3.

b) In the next stage, a multiplicity of transverse holes 9 are machined in the aerofoil shaped portion 3 of the blade 1 substantially perpendicularly to the profile of the portion 3 as shown in FIGS. 2 and 3, any suitable method being used for this purpose. An area 10, the width 1 of which is determined depending on the mechanical characteristics desired for the blade 1, is left free of holes 9 in the vicinity of the leading and trailing edges 6 and 7, and at the tip of the blade 1. Holes 9 may also be formed in the transition portion 8 of the blade 1. As can been seen in FIGS. 2 and 3, and also in FIG. 4 which illustrates one distribution arrangement of the holes 9, the holes 9 form a close network and the wall thickness 11 between adjacent holes 9 is determined according to the mechanical characteristics desired for the blade 1. In the designated areas the cavity ratio may be close to 90%. It is also possible, in certain applications, to drill the holes 9 in a direction substantially perpendicular to the chord of the blade profile.

c) At the same time, plug-like elements 12 are made having a peripheral outline which corresponds to that of the holes 9 of the blade 1, the sizing being such as to achieve a sliding fit between the plugs 12 and the holes. By using suitable machining means, which may be digitally controlled, the outer surface 13 of each plug 12 is matched to the desired profile of the surface of the aerofoil portion 3 of the blade at the intended position of the plug 12. The thickness 14 of the bottom wall of the plug 12 corresponds to the specific thickness desired for the blade wall. On its inner side a suitable transition radius 15 is provided between the bottom wall and the cylindrical side wall 16 of each plug 12.

d) All the plugs 12 are then placed and held in position in the holes 9, both on the intrados face side and the extrados face side of the blade 1.

e) Each plug 12 is then permanently secured by high energy beam welding at the periphery of the plug 12 within the housing formed by the respective hole 9 of blade 1. Depending on particular applications the method of carrying this out may vary. For example, welding may be carried out simultaneously on a first plug 12 situated on the intrados side of the blade 1 and on a second plug 12 situated on the extrados side of the blade 1. Alternatively, the welding may be effected in succession, in the appropriate order, on one side and then on the other side, this enabling the risk of deformation to be minimized. The high energy beam used for welding may be an electron beam originating from a laser source.

f) When all the plugs have been secured by welding, the usual verification operations are carried out followed by the finishing work necessary to obtain the desired final aerodynamic profile and surface finish of the blade.

A hollow blade 1 obtained by the production process which has just been described with reference to FIGS. 1 to 5 has appreciable advantages, in addition to the ease of carrying out the said process, with regard to the making of the plugs 12 and their welding. Compared to some previously known methods which require the use of two rough parts, the invention requires only one rough forged part. The technical characteristics of the hollow blade 1 obtained are also advantageous. In particular, an overall cavity ratio of the order of 60% to 70% is obtained for the finished blade 1. The shape of the plugs 12, and particularly the definition of the transition radius between the bottom wall and side wall, gives them a good resistance to impact, which is an important characteristic of the fan blades to which the invention applies. In addition, the orientation of the plug welds is favorable relative to the direction of mechanical stresses experienced during operation, and provides adequate resistance to fatigue stresses.

Figure 6:
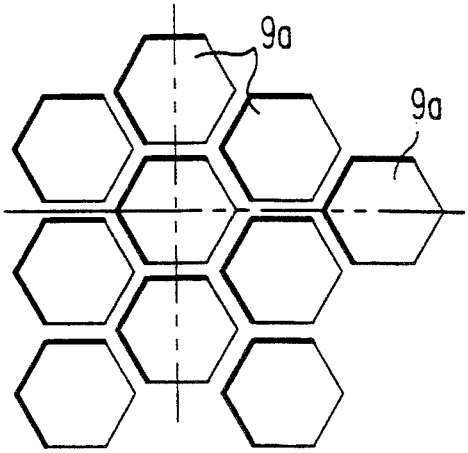
FIG. 6 is a view similar to FIG. 4 but showing the shape and distribution of the cavities in another embodiment.
Figure 5:
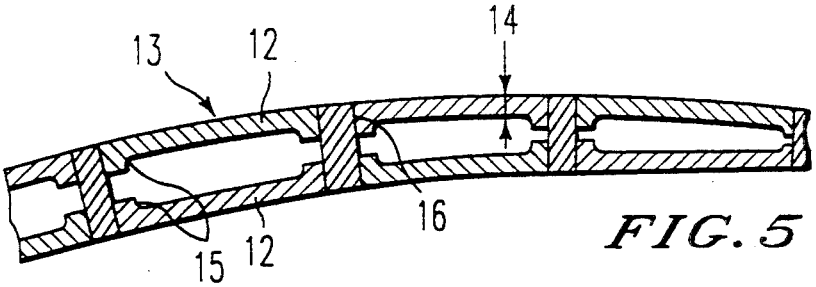
FIG. 5 is a cross-section through part of a blade showing the arrangement of the plugs in the cavities in one embodiment of the invention.
Figure 7:
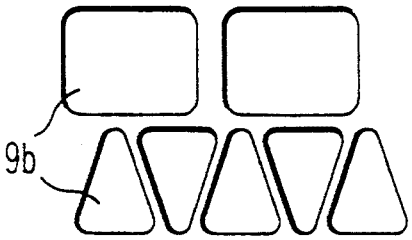
FIG. 7 is a view similar to FIGS. 4 and 6, but showing the shape and distribution of cavities in yet another embodiment.

The structure of the hollow blade 1 as described above may be the subject of various modifications within the scope of the invention. In particular, the geometrical shape of the cavities or holes 9 and the shape resulting therefrom for the periphery of the corresponding plugs 12 is shown as circular in FIGS. 2 and 4. However, other geometrical shapes may be envisaged, such as rectangular with rounded corners, and a shape which is particularly advantageous in certain applications is a hexagonal shape as diagrammatically shown at **9*a* in FIG. 6. FIG. 7 shows another possible arrangement for the geometry of the cavities 9*b*** and the corresponding plugs. The geometry chosen is optimized in each case by strength calculations corresponding to the conditions of use.

Figure 8:
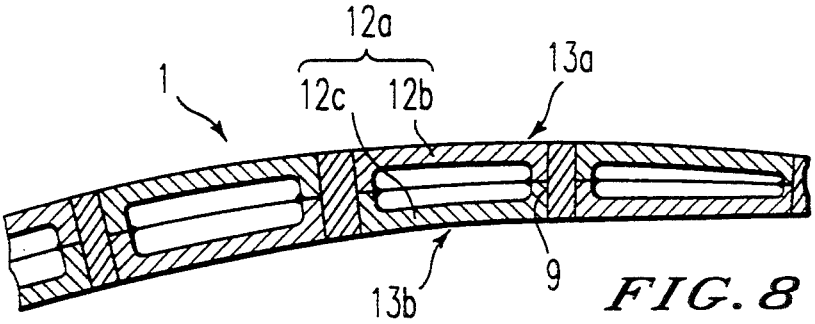
FIG. 8 is a view similar to FIG. 5, but showing the arrangement of the plugs in a different embodiment.

FIG. 8 shows diagrammatically another alternative embodiment. Each plug **12*a* is in this case formed from two parts, or half plugs, 12*b* and 12*c* which are welded together before being placed in position in a hole 9 of the blade 1. After being placed in position, an outer surface 13*a* of the plug 12*a* forms a part of the extrados face of the blade 1, while the other outer surface 13*b* of the plug 12*a* forms a part of the intrados face of the blade 1**. The stages of (d) placing in position, (e) welding, and (f) finishing in this embodiment may be carried out as previously described.

The holes or cavities 9 or **9*a* in the embodiments described above are through holes, but it is envisaged that, for certain particular applications, blind holes, either in the intrados face or in the extrados face of the blade 1**, may be used. It follows that in this case only one plug is placed in each hole on the recessed side of the blade.

Figure 9:
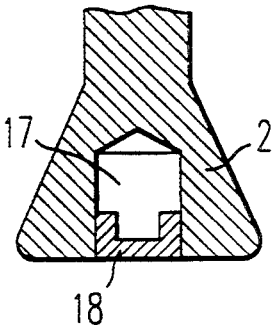
FIG. 9 is a diagrammatic cross-sectional view along line VIII—VIII of FIG. 2 showing a plugged cavity in the root of the blade.

In addition, in certain applications cavities may also be formed in the root 2 of the blade. In this case, blind holes 17 are made in the root 2, and a plug 18 is fitted and welded in each hole 17, as diagrammatically shown in FIG. 9.

I claim:

1. A hollow blade for a turbomachine, said blade including an aerofoil shaped portion having an intrados face and an extrados face, said blade comprising:

a unitary body, means in said body defining a multiplicity of transverse cavities in said aerofoil shaped portion, and plugs disposed within said cavities to restore the surface continuity of said intrados and extrados faces of said aerofoil shaped portion of said blade, said plugs being rigidly secured to said unitary body wherein each of said cavities contains a single plug of said plugs, and wherein said single plug comprises two half-plugs which are rigidly joined together by welding.

2. A hollow blade according to claim 1 wherein said cavities comprise through holes.

3. A hollow blade according to claim 1 wherein said cavities comprise blind holes formed in said intrados face of said aerofoil shaped portion of said blade.

4. A hollow blade according to claim 1 wherein said cavities comprise blind holes formed in said extrados face of said aerofoil shaped portion of said blade.

5. A hollow blade according to claim 1 wherein said cavities have a circular cross-section.

6. A hollow blade according to claim 1 wherein said cavities have a hexagonal cross-section.

7. A hollow blade according to claim 1 wherein said cavities have a cross-sectional shape with rounded corners, said shape being optimized on the basis of calculations of strength under operating conditions.

8. A hollow blade according to claim 2, wherein each of said through holes contains a first half plug of said two half plugs on the intrados face side of said aerofoil shaped portion, and a second half plug of said two half plugs on the extrados face side, said first and second half plugs being rigidly secured to said body by welding.

9. A hollow blade according to claim 1, wherein said blade has an area of a predetermined width and said cavities are not present in said area.

10. A hollow blade according to claim 1, wherein said blade has a root and a transition zone between said root and said aerofoil portion of said blade, and said cavities are provided in said transition zone as well as in said aerofoil portion.

11. A hollow blade according to claim 10 wherein said cavities are also provided in said root of said blade, said cavities in said root comprise blind holes, and said plugs in said root cavities are secured to said body by welding.

12. A hollow blade for a turbomachine, said blade including an aerofoil shaped portion having an intrados face and an extrados face, said blade comprising:

a unitary body wherein the aerofoil shaped portion has a multiplicity of transverse cavities formed therein; and a plurality of plugs respectively disposed within said cavities to restore the surface continuity of said intrados and extrados face of said aerofoil shaped portion of said blade, said plugs being rigidly secured to said unitary body wherein each of said cavities holes contains a single plug of said plurality of plugs and wherein said single plug comprises two half-plugs which are rigidly joined together by welding.

13. A hollow blade according to claim 12, wherein said cavities comprise through holes.

14. A hollow blade according to claim 12, wherein said cavities comprise blind holes formed in said intrados face of said aerofoil shaped portion of said blade.

15. A hollow blade according to claim 12, wherein said cavities comprise blind holes formed in said extrados face of said aerofoil shaped portion of said blade.

16. A hollow blade according to claim 12, wherein said cavities have a circular cross-section.

17. A hollow blade according to claim 12, wherein said cavities have a hexagonal cross-section.

18. A hollow blade according to claim 12, wherein said cavities have a cross-sectional shape with rounded corners, said shape being optimized on the basis of calculations of strength under operating conditions.

19. A hollow blade according to claim 13, wherein each of said through holes contains a first half plug of said two half plugs on the intrados face side of said aerofoil shaped portion, and a second half plug of said two half plugs on the extrados face side, said first and second half plugs being rigidly secured to said body by welding.

20. A hollow blade according to claim 12, wherein said blade has an area of a predetermined width and said cavities are not present in said area.

21. A hollow blade according to claim 12, wherein said blade has a root and a transition zone between said root and said aerofoil portion of said blade, and said cavities are provided in said transition zone as well as in said aerofoil portion.

22. A hollow blade according to claim 21, wherein said cavities are also provided in said root of said blade, said cavities in said root comprise blind holes, and said plugs in said root cavities are secured to said body by welding.

* * * * *

UNITED STATES PATENT AND TRADEMARK OFFICE

CERTIFICATE OF CORRECTION

PATENT NO. : 5,407,326

DATED : April 18, 1995

INVENTOR(S) : Alain M. J. LARDELLIER

It is certified that error appears in the above-indentified patent and that said Letters Patent is hereby corrected as shown below:

Column 3, line 25, change "holes." to --holes 9.--

Column 5, line 39, delete "holes".

Signed and Sealed this

Eighteenth Day of July, 1995

Bruce Lehman

*Attest:*

BRUCE LEHMAN

*Attesting Officer*

*Commissioner of Patents and Trademarks*